US006887069B1

(12) United States Patent
Thornton et al.

(10) Patent No.: US 6,887,069 B1
(45) Date of Patent: May 3, 2005

(54) REAL-TIME COMBUSTION CONTROLS AND DIAGNOSTICS SENSORS (CCADS)

(75) Inventors: Jimmy D. Thornton, Morgantown, WV (US); George A. Richards, Morgantown, WV (US); Keith A. Dodrill, Fairmont, WV (US); Roy S. Nutter, Jr., Morgantown, WV (US); Douglas Straub, Morgantown, WV (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 0 days.

(21) Appl. No.: 09/955,582

(22) Filed: Sep. 18, 2001

Related U.S. Application Data

(63) Continuation-in-part of application No. 09/585,540, filed on Jun. 2, 2000, now Pat. No. 6,429,020.

(51) Int. Cl.[7] ..... F23N 5/12; G01N 30/68

(52) U.S. Cl. ..... 431/12; 431/25; 431/78; 431/354; 340/579; 436/154; 324/468

(58) Field of Search ..... 431/12, 78, 79, 431/24, 25, 346, 89, 90, 202, 354; 340/579; 436/154, 153; 324/468; 250/379, 374

(56) References Cited

U.S. PATENT DOCUMENTS 3,473,895 A * 10/1969 Brittan et al. ..... 422/54
4,410,854 A * 10/1983 Kroneisen et al. ..... 324/468
4,965,048 A * 10/1990 Ogasawara ..... 422/54
5,073,753 A * 12/1991 Collings et al. ..... 324/468
5,588,825 A * 12/1996 Kostiuk et al. ..... 431/349
5,676,712 A * 10/1997 Anderson ..... 48/192

FOREIGN PATENT DOCUMENTS

DE 44 25 304 A1 * 2/1996 ..... G01N/30/68
GB 2 037 066 A * 7/1980 ..... G01N/30/68

* cited by examiner

*Primary Examiner*—Josiah Cocks
(74) *Attorney, Agent, or Firm*—Mark F. LaMarre; Thomas G. Anderson; Paul A. Gottlieb

(57) ABSTRACT

The present invention is directed to an apparatus for the monitoring of the combustion process within a combustion system. The apparatus comprises; a combustion system, a means for supplying fuel and an oxidizer, a device for igniting the fuel and oxidizer in order to initiate combustion, and a sensor for determining the current conducted by the combustion process.

The combustion system comprises a fuel nozzle and an outer shell attached to the combustion nozzle. The outer shell defines a combustion chamber. Preferably the nozzle is a lean premix fuel nozzle (LPN). Fuel and an oxidizer are provided to the fuel nozzle at separate rates. The fuel and oxidizer are ignited.

A sensor positioned within the combustion system comprising at least two electrodes in spaced-apart relationship from one another. At least a portion of the combustion process or flame is between the first and second electrodes. A voltage is applied between the first and second electrodes and the magnitude of resulting current between the first and second electrodes is determined.

14 Claims, 12 Drawing Sheets

TYPICAL CONTROL CIRCUIT FOR FLASHBACK DETECTION SENSOR

TYPICAL CURRENT MEASURING DEVICE

SHOWS THE AVERAGE CURRENT MEASUREMENTS OVER A RANGE OF APPLIED VOLTAGE (Vbias) AND EQUIVALENCE RATIOS, AT 10m/s BULK VELOCITY USING THE ISOLATED ELECTRODE COMBUSTION CONFIGURATION.

DATA FROM THE ISOLATED ELECTRODE CONFIGURATION: (A) THE AVERAGE OH MEASUREMENTS AT A RANGE OF EQUIVALENCE RATIOS

DATA FROM THE ISOLATED ELECTRODE CONFIGURATION: (B) THE AVERAGE CURRENT WITH Vbias OF 100 VDC AT A RANGE OF EQUIVALENCE RATIOS (A)

DATA FROM THE ISOLATED ELECTRODE CONFIGURATION: (A) THE AVERAGE OH MEASUREMENTS AT A RANGE OF FUEL FLOW RATES

DATA FROM THE ISOLATED ELECTRODE CONFIGURATION: (B) THE AVERAGE CURRENT WITH Vbias OF 100 VDC AT A RANGE OF FLOW RATES.

(A)

DATA FROM THE METAL COMBUSTOR CONFIGURATION: (A) THE AVERAGE OH MEASUREMENTS AT A RANGE OF EQUIVALANCE RATIOS (B)

DATA FROM THE METAL COMBUSTOR CONFIGURATION: (B) THE AVERAGE CURRENT MEASUREMENTS AT A RANGE OF EQUIVALENCE RATIOS

REAL-TIME COMBUSTION CONTROLS AND DIAGNOSTICS SENSORS (CCADS)

Priority

This application is a Continuation-in-part of U.S. patent application Ser. No. 09/585,540 filed on Jun. 2, 2000, now U.S. Pat. No. 6,429,020.

STATEMENT REGARDING FEDERALLY SPONSORED RESEARCH OR DEVELOPMENT

The United States Government has rights in this invention pursuant to the employer-employee relationship of the U.S. Department of Energy and the inventor.

BACKGROUND OF THE INVENTION

1. Field of the Invention

The present invention relates to a combustion monitoring system in general, and in particular to a system for monitoring conditions in the combustion system of a gas turbine.

2. Brief Discussion of the Related Art

Many industrial processes such as power generation, metal smelting and processing, waste incineration and vitrification, glass melting, crude oil refining, petrochemical production, and the like use burners as the primary or as an auxiliary source of energy. These burners have one or more inlets for hydrocarbon based fossil fuels such as, but not limited to, natural gas, liquefied petroleum gas, liquid hydrocarbon-based fuel, and the like, which are combusted to produce heat. The fuels are burned in a combustion chamber where the energy that is released by the combustion is transferred in the form of heat for the required purpose. The combustion requires an oxidant, such as air, oxygen-enriched air, or oxygen. In most cases, the oxidant is preheated in order to provide for more efficient combustion.

Precise monitoring and control of the combustion process is very important for the efficient and safe operation of industrial processes. For example, it is well known that burning a fuel with excess air as the oxidant yields higher nitrogen oxides ($NO_x$) emissions, especially when the air is preheated. On the other hand, incomplete combustion of a fuel generates carbon monoxide (CO). Both $NO_x$ and CO are dangerous pollutants, and governmental environmental authorities regulate the emission of both gases.

Stringent environmental emission regulations have motivated changes in the design and operation of combustion processes, in particular gas combustion systems. Many developers of gas combustion systems, such as stationary gas turbines, use some form of lean-premix combustion (LPM). In LPM systems, fuel is mixed with air upstream of the combustion zone at deliberately fuel-lean conditions. A significant reduction of thermal $NO_x$ formation is achieved using LPM system. Research activities by both U.S. Government laboratories and the private sector have been conducted, with specific goals for $NO_x$ emissions of less that 10 ppm. To meet the target $NO_x$ levels, modem premix turbine combustors must operate with a finely controlled fuel/air ratio, near the lean extinction limit. In practice, changes in flow splits caused by manufacturing tolerances or engine wear can compromise emissions performance. Furthermore, unexpected changes in fuel composition, or momentary changes in fuel delivery can lead to problems with flame anchoring.

Serious engine damage can result when premixed flames flashback, yet there are currently no methods to sense when flashback may be incipient. Related problems can arise from autoignition, where fuel begins to burn in the premixer without any flashback. Because of the presence of heavy hydrocarbons or pipeline cleaning solvents in natural gas, the operating margin for autoignition may be compromised in high-pressure gas turbines. Likewise, operation near lean-blowoff is desired to reduce $NO_x$ emissions, but this complicates the change to different fuels, because the flame anchoring will be different on different fuels near lean-blowout.

Due to these issues, there is a growing need to both measure and control the behavior of flames and, in turn, the combustion process in gas turbine combustors. The measurement of combustion parameters when coupled with a combustion control strategy presents numerous unique issues due to the extreme process conditions under which the combustion process occurs.

Numerous systems are available for the measurement of flames in burners, and in particular gas turbines. For example, commercially available UV flame detectors can be used to monitor the status (flame on or off) of a flame. Alternatively, a photocell may be used as the detector. At least one element of the photocell is coated with a sulfide compound, such as cadmium-sulfide or lead-sulfide, so as to be sensitive to the particular wavelengths of light emitted by a flame occurring during a flashback condition. For instance, the electrical resistance of cadmium-sulfide decrease directly with increasing intensity of light, and like lead-sulfide, will function as a variable resistor. However, when used to detect the presence of a flame, a cadmium-sulfide photocell is useful only for sensing that portion of the flame occurring in the visible light wavelengths. Further, these types of flame monitoring device do not provide information on the combustion product mixture. It may be difficult to determine whether the burner is operated under fuel rich, fuel lean, or stoichiometric (exact amounts of fuel and oxidant to obtain complete combustion of the fuel, equivalence ratio equal to 1). Further, flame detectors based on the measurement of selected wavelengths of the electromagnetic spectrum are typically self contained devices that are not always integrated in the burner design.

Endoscopes may also be used within industry to visually inspect flames, and their interaction between the furnace load. They are generally complicated and expensive pieces of equipment that require careful maintenance. To be introduced into very high temperature furnaces or burners, they require external cooling and flushing means: high-pressure compressed air and water are the most common cooling fluids. When compressed air is used, uncontrolled amounts of air are introduced in the furnace and may contribute to the formation of $NO_x$. Water jackets are subject to corrosion when the furnace atmosphere contains condensable vapors.

Thermocouples and bimetallic elements when used to monitor the combustion process within the fuel nozzles, suffer from the disadvantages of providing only localized point measurements and generally slow reaction times (typically 2 to 3 minutes), which can lead to problems and possible failure of the fuel nozzle before detection. Another disadvantage of these sensors is that, since they only detect heat, they are unable to distinguish between heat generated by the flame of a flashback condition and the heat radiated by the normal combustion process of the gas turbine combustion system.

Additionally, control of the combustion process necessitates ongoing monitoring of the chemical compositions of the fuel, oxidant, and the products of combustion. Due to the extreme environmental conditions a number of problems must be addressed as part of a combustion control system.

Placement of an in-situ oxygen sensor at the burner exhaust can provide a control solution for overall combustion ratio control. However, typical oxygen sensors, such as zirconia-base sensors that are commercially available have limited lifetime and need to be replaced frequently. One difficulty met when using these sensors is a tendency to plug, especially when the exhaust gases contain volatile species or particulate. Further, when more than one burner is utilized, a drawback of global combustion control is that it is not possible to know whether each individual burner is properly adjusted or not. This technique also has long response times due to the residence times of the burner gases in the combustion chamber, which can exceed 30 seconds.

Continuous monitoring carbon monoxide of the flue gas, for example in so-called post combustion control of a burner assembly, provides another means of controlling the combustion. This involves the use of a sophisticated exhaust gas sampling system, with separation of the particulate matter and of the water vapor. Although very efficient, these techniques are not always economically justified. Also, the light emissions observed from the flame are one of the most useful systems for providing information on the chemical, as well as physical processes, as noted hereinabove, that take place in the combustion process. For example, Cusack et al., U.S. Pat. No. 6,071,114 uses a combination of ultraviolet, visible and infrared measurements to characterized the flame to determine relative levels of some chemical constituents. While monitoring the flame light emission can be easily performed in well controlled environments typically found in laboratories, implementing flame light emission monitoring on industrial burners used in large combustion units is quite difficult in practice, resulting in a number of problems. First, clear optical access is necessary which requires positioning of a viewing port in a strategic location with respect to the flame for collecting the flame light emission. Second, the environment is difficult because of excessive heat being produced by the burner. Typically the high temperature-operating environment of the burners necessitates the need for water or gas cooled probes for use either in or near the burner. Finally, the environment may be dusty which is not favorable for the use of optical equipment except with special precautions, such as gas purging over the optical components.

Control of the combustion process at the burner can be performed by metering the flows of fuel and oxidant, through appropriately regulated valves (electrically or pneumatically driven) that controlled by a programmable controller (PC). The ratio of oxidant to fuel flow is predetermined using the chemical composition of the natural gas and of the oxidant. To be effective, the flow measurements for the fuel and oxidant must be very accurate and readjusted on a regular basis. Typically this situation often leads the operator to use a large excess of air to avoid the formation of CO. Further, typical combustion control strategies do not account for the air intakes that naturally occur in industrial burners that bring in unaccounted quantities of oxidant into the combustion zone, nor does this control scheme account for the variation of the air intakes caused by pressure changes in the burner. Another drawback is that the response time of the feed-forward regulation loop is generally slow, and cannot account for cyclic variatons of oxidant supply pressure and composition that occur when the oxidant is not pure oxygen. Other drawbacks of combustion control strategy result from variations due to fuel composition and pressure.

Other combustion control systems use acoustic control of flames. Most of these systems were developed for small combustion chambers in order to avoid extinction of flames, and are triggered by instabilities of flames.

While currently available systems have been able to achieve some degree of control over the combustion in a burner, there is a need for a fast response time monitoring and control system that is durable, and yet requires minimal modification of the burner assembly and the operating parameters of the burner in order to avoid the previously described problems.

Flame Ionization

Volumes of literature describe investigations of electrical conductivity through gases. The electrical properties of flames and the mechanisms for the formation of ions in flames have been studied extensively. The flame ionization detector (FID) commonly used in gas chromatography uses the electrical properties of flames to determine very low concentration of hydrocarbons. Many investigations using hydrocarbon flames suggest that a large portion of the ionization result from "chemical ionization" in the flame front. Consequently, the reaction most often cited for providing the FID response results from the chemical ionization of CHO*:

$$CH+O \rightarrow CHO^* \rightarrow CHO+e-$$

Although the mechanism for providing the response is still debated, the FID is considered a carbon counting device. The FID response is proportional to the number of carbon atoms or the concentration of hydrocarbons in the sample. Cheng et al., *The Fast-Response Flame Ionization Detector*, Prog. Energy Combustion Science, vol. 24, 1998, pp. 89–124, described the equation for the current measured in the FID as $$i=r[C_nH_m]Q,$$

where r is the charge per mole of hydrocarbon, $[C_nH_m]$ is the molar concentration of the hydrocarbons, and Q is the volumetric flow rate. The linearity of the FID measurements depends on the consistency of charge collection. This is accomplished mainly by providing consistent inlet bulk flow velocity, providing a constant electric field across the flame, and using a hydrogen flame to ignite the inlet sample and maintain a consistent flame anchor.

Other investgations have shown the feasibility of using flame ionization of monitoring and control of internal combustion (IC) engines. Eriksson et al., *Ionization Current Interpretation for Ignition Control in Internal Combustion Engines*, L. Eriksson, and L. Nielsen, Control Engineering Practice, Vol. 5 (8), 1997, pp. 1107–1113, demonstrated the feasibility of using in cylinder ionization-current measurements to control IC engine spark advance. Watterfall et al., "Visualizing Combustion Using Electrical Impedance Tomography, *Chemical Engineering Science*, vol. 52, Issue 13, Jul. 1997, pp. 2129–2138, demonstrated using impedance tomography to visualize combustion in an IC engine. The results of Waterfall show a linear variation of capacitance with the operating air-to-fuel ratio. The main similarity is the use of a direct-current (DC) electric field to yield a current measurement that relates to the flame parameters.

Safety of operation is an essential characteristic expected from all industrial combustion systems. Automated control of the presence of the flame in the combustion can be used to stop the flow of oxidant when the fuel flow is suddenly interrupted.

SUMMARY OF THE INVENTION

It is an object of the present invention to provide a combustion detector for a lean premix combustion system, such that the detector can be readily incorporated into the burner assembly with minimal modification of the burner itself.

These and other objects of the invention, which will becomne apparent from the following description, have been achieved by a novel apparatus for the monitoring of the combustion process within a combustion system. The apparatus comprises; a combustion system, a means for supplying fuel and an oxidizer, a device for igniting the fuel and oxidizer in order to initiate combustion, and a sensor for determining the current conducted by the products of combustion. The combustion system comprises a fuel nozzle and an outer shell attached to the combustion nozzle. The outer shell defines a combustion chamber. Preferably the nozzle is a lean premix fuel nozzle (LPN).

Fuel and an oxidizer are provided to the fuel nozzle at separate rates. The fuel and oxidizer are ignited thereby initiating the combustion process, which produces a flame. One of the products of the combustion process is hydrocarbon ions;

A sensor is positioned within the combustion system. The sensor includes a first electrode and a second electrode in spaced-apart relationship to one another. This spaced-apart relationship forms a gap between the first and second electrode. At least a portion of the combustion process or flame is between the first and second electrodes. A voltage is applied between the first and second electrodes and the magnitude of resulting current between the first and second electrodes is determined. The device for the measurement of current may be used to determine a change in the magnitude of the current. When the change in the current is several orders of magnitude, such as a relative reduction from 100 to 1, this may indicate the flame has gone out or that the combustion process has stopped. This can be used to determine the presence of a flame within the combustion system.

The sensor may be arranged so that the first electrode is axially centered in the fuel nozzle adjacent to the second end. The second electrode may be radially outward of the first electrode or spaced axially from the first electrode in a spaced-apart relationship in order to form a gap. The sensor second electrode may be form as part of the outer shell and the outer shell is electrically insulated from the second end of the nozzle. The first and second electrodes may be spaced apart and insulated by a ceramic material. The sensor may also be located entirely within the combustion chamber.

The fuel and oxidizer may be supplied to the fuel nozzle at separated rate and controlled such that the control mechanism is electronically coupled to the mechanism for determining the magnitude of the current between the first and second electrodes. The rate at which fuel is supplied to the nozzle and the rate of supply of oxidizer to the nozzle may be maintained at about a constant level, wherein a decrease in the magnitude of the current indicates the movement of the combustion process (flame) away from the first electrode. Normally, the apparatus the change in the magnitude of the current is proportional to the change in the amount of hydrocarbon ions in the combustion process.

The preferred apparatus for the monitoring and control of the combustion process in a lean premix combustion system, the system comprises; a lean premix combustion system comprising a fuel nozzle and an outer shell in fluid communication with the combustion nozzle. The central area of the fuel nozzle is called a center body. The outer shell defines a combustion chamber.

Fuel and an oxidizer are provided to the fuel nozzle at separate rates. The amount of oxidizer fuel supplied is slightly greater than the stoichiometric required. The fuel and oxidizer are ignited thereby initiating the combustion process, which produces a flame. One of the products of the combustion process is hydrocarbon ions;

A sensor positioned within the lean premix combustion system. The sensor includes a first electrode and a second electrode in spaced relationship of the first electrode. The first electrode is centered in the nozzle center body and the sensor second electrode is part of the outer shell of the nozzle. At least a portion of the combustion process takes place between the first and second electrodes. A voltage is applied between the first and second electrodes. The magnitude of current between the first and second electrodes is measured.

The process for monitoring and control of the combustion process in a lean premix combustion system, providing a combustion system comprising a fuel nozzle having a fuel inlet, a gas inlet, and an outer shell, wherein at a portion of the outer shell defines a combustion zone and a sensor positioned within the combustion system, the sensor includes a first electrode and a second electrode in spaced-apart relationship of the first electrode. A fuel is to the fuel nozzle at a first rate. An oxidizer is supplied to the fuel nozzle at a second rate. The fuel and the oxidizer are mixed. The fuel-oxidizer mixture is ignited such that the combustion process (flame) proceeds. At least a portion of the combustion process takes place between the first and second electrodes. A voltage between the first and second electrodes; and the magnitude of a current between the first and second electrodes is measured. Preferably, the first rate at which the fuel is supplied is adjusted to maintain the magnitude of the current between the first and second electrode at about a constant level. Alternatively, the second rate at which the oxidized is supplied is adjusted to maintain the current between the first and second electrode at about a constant level.

DETAILED DESCRIPTION OF THE PREFERRED EMBODIMENT

Figure 1:
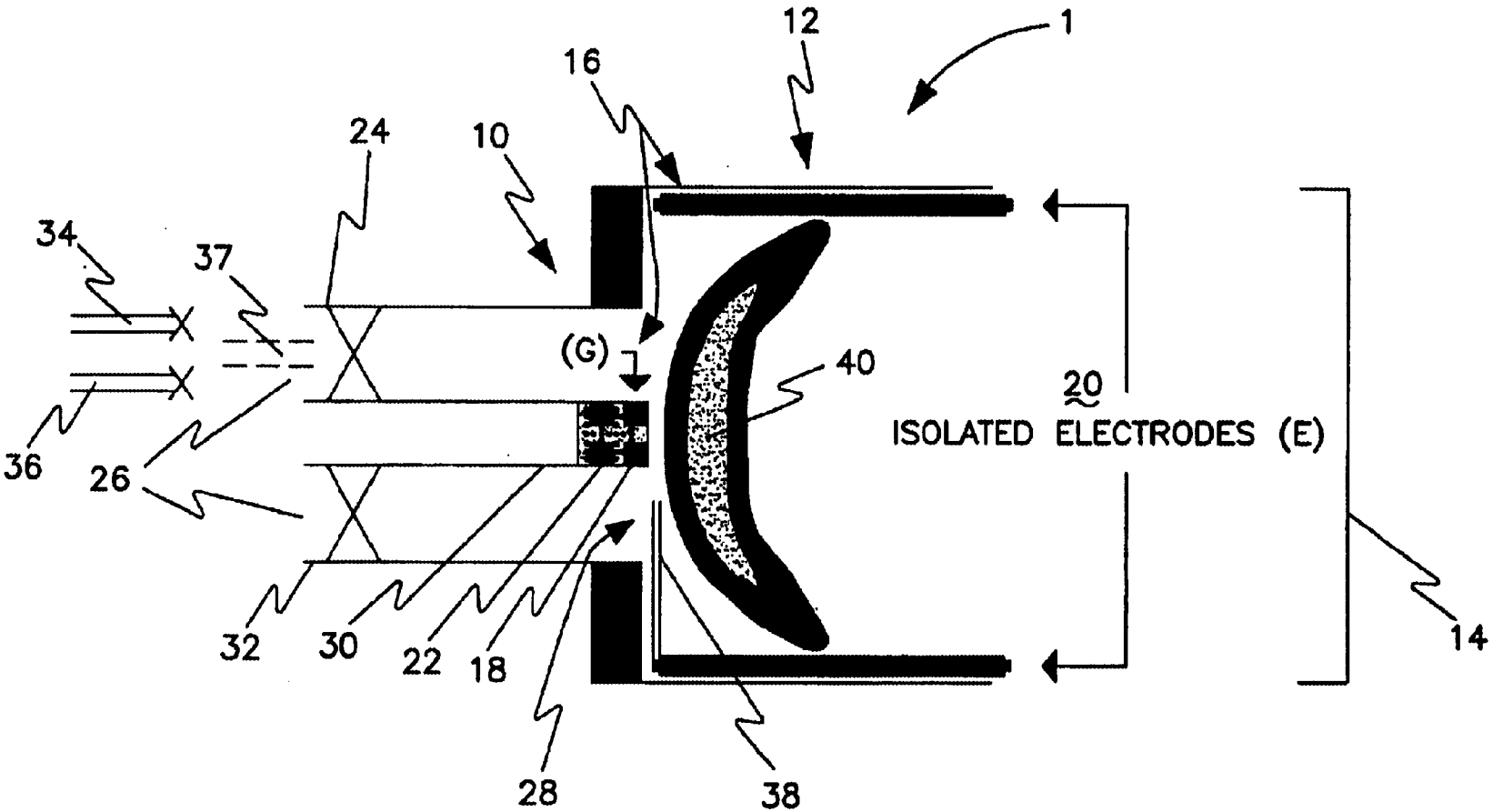
FIG. 1 is an illustration of the present invention situated on the center-body of a typical fuel nozzle of a lean premix combustion system.

A combustion system shown generally at 1 in FIG. 1, comprises a fuel nozzle 10 with a combustion chamber 12 attached thereto. The combustion chamber defines a combustion zone 14. The combustion sensor 16 of the present invention, which comprises a first electrode 18 and a second combustion electrode 20 or a combustion ground. Also, shown herein is the flashback first sensor electrode 22 as described in patent application Ser. No. 09/585,540 which invention is assigned to the assignee of the present invention, and is incorporated herein by reference. Throughout this discussion, the combustion sensor 16 may alternatively be referred to as the sensor, the combustion detector or the detector, all of which in either case are meant to refer to the combustion sensor 16 of the present invention.

A cross-section drawing of a typical combustion chamber 12 is shown in FIG. 1. This combustion chamber 12 is representative of lean premix combustion chambers for use with the combustion sensor 16 of the present invention. Discussion of the combustion sensor 16 of the present invention will be made with respect to the typical combustion chamber 12. When multiple combustion chambers are incorporated into the gas lean premix system, each combustion chambers should be provided with its own combustion sensor 16. Also for simplicity of discussion, only the combustion chamber 12, fuel nozzle 10 and swirl vanes 24 are shown in FIG. 1. The other various parts of a gas combustion system mentioned above will not be discussed further.

The fuel nozzle 10 comprises an inlet section 26 extending from the pre-mixer section (not shown), and an outlet port 28 leading into the combustion chamber 12 and combustion zone 14. Swirl vanes 24 are positioned proximate to the inlet section 26, and are affixed to the center body 30 and the nozzle outer wall 32. The pre-mixer section includes a fuel inlet 34 and an oxidant inlet 36.

The swirl vanes 24 serve to provide for thorough burning of the fuel/air mixture within the combustion zone 14 by ensuring that the fuel/air mixture will be well blended, thereby producing the richest possible combustion.

In most cases, air, as the oxidant and gaseous fuel are mixed in the pre-mixer section located in the fuel nozzle 10. The fuel/air mixture 37 is introduced into the fuel nozzle 10 through inlet 26. The fuel/air mixture 37 is then injected into the combustion zone 14 through nozzle outlet ports 28. An ignition source 38 ignites the fuel/air mixture thereby initiating the combustion process 40 or flame.

Figure 2:
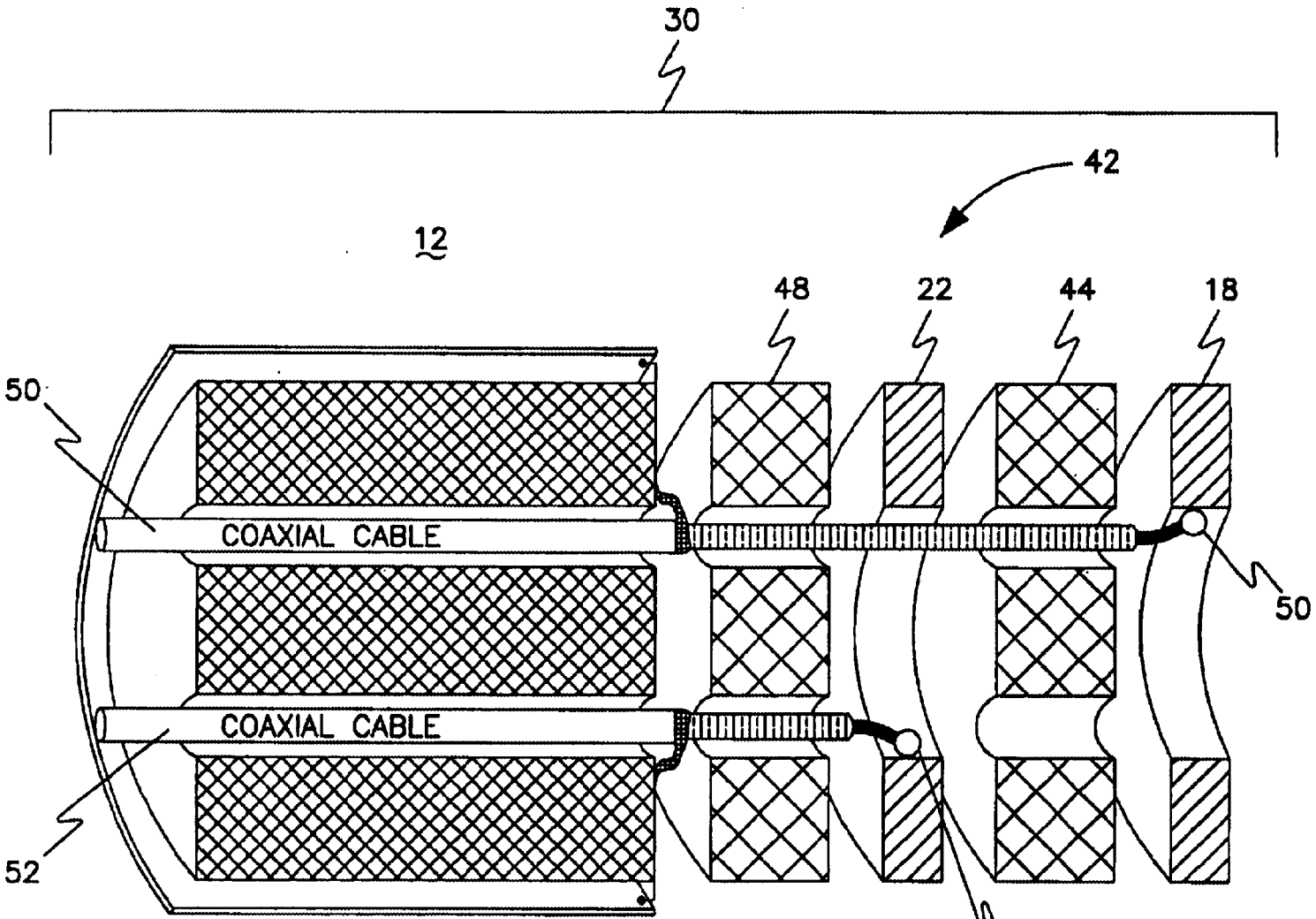
FIG. 2 is a cross-secfion illustration of the present invention.

The structure of the combustion first electrode 18 of the present invention and the associated electrode assembly, shown generally as 42 in FIG. 2. The assembly 42 is made up of two main components, a combustion first electrode 18, also referred to as a guard electrode G for other uses, and a first insulator 44. The flashback first electrode 22, shown here, while not of primary importance for this invention, has utility for sensing other combustion conditions. The first combustion electrode 18 is made of an electrically conducting material, such as metal that is capable of withstanding the normal operating temperatures produced in a combustion system. The material should also be able to withstand the high temperatures presented during normal combustion and flashback conditions.

The first insulator 44 is made of a non-conducting but rugged material, such as an engineered thermoplastic or ceramic, that is also able to withstand both the normal operating temperatures produced during combustion in a gas turbine system as well as the high temperatures presented during a flashback condition. The sensor body 44 preferably has a circular shape with a smooth surface. The first combustion electrode 18 and the flashback first electrode 46 are securely seated in the center body 30. These electrodes are electrically and physical isolation from one another, but in such manner that a significant portion of the face of the combustion first electrode 18 and the flashback first electrode 22 are exposed. The flashback first electrode 22 is electrically insulated from the rest of the center body 30 by insulator 48. The combustion first electrode 18 is electrically charged by coaxial cable 50. The flashback first electrode 22 is electrically charged by coaxial cable 52.

Figure 3:
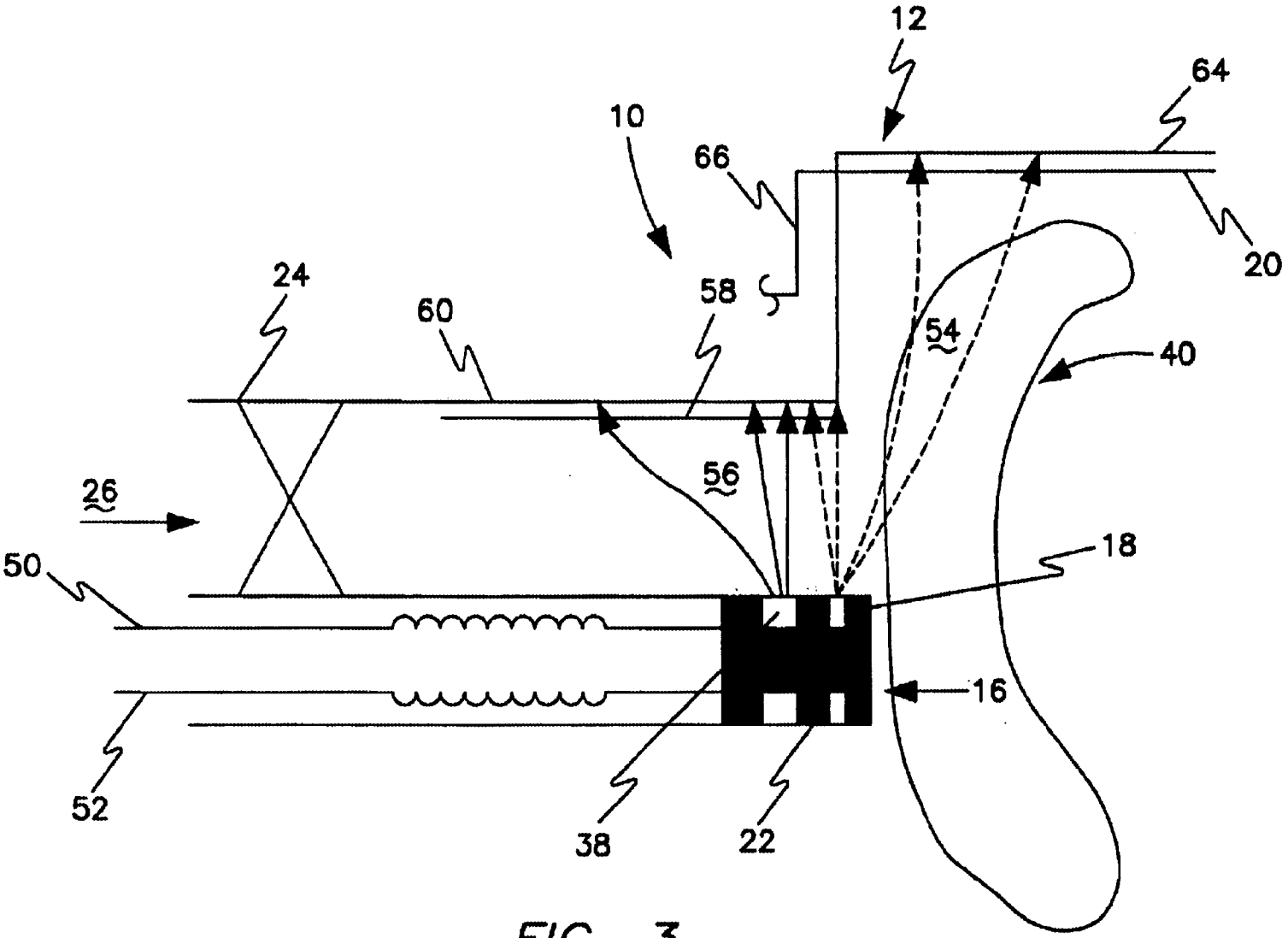
FIG. 3 is a sectional view of the present invention while situated in a typical fuel nozzle of a lean premix combustion system.

The first combustion electrode 18 is securely fastened to the nozzle center body 30 within the fuel nozzle 16 at a location downstream from the pre-mixer section of the gas combustion system, but in close proximity to the combustion chamber 12, as shown in FIGS. 1 and 2. The first combustion electrode 18 is located on the nozzle center body 30 so as to expose the first combustion electrode 18 to the combustion process 40 which takes place within the combustion zone 14. FIG. 3 provides a detailed view the fuel nozzle 10, combustion chamber 12 and combustion sensor 16, so as to illustrate the current between the first 18 and second combustion electrodes 20. One potential current path 54 extends between the first combustion electrode 18 and the second the second combustion electrode 20 (combustion ground). At least a portion of the combustion process (flame) 40 is between the two electrodes. A second electrical field 56 extends between the flashback first electrode 22 and the flashback ground 58. The flashback ground 58 may be incorporated in the nozzle wall 60, applied as a coating to the inner wall 62 thereof, or maintained at a short distance therefrom 58. The fuel nozzle 10, swirl vanes 24, fuellair inlet 26, and the combustion zone outer wall 64 remain the same as shown and discussed with respect to FIG. 1.

The combustion zone electric field 54, extend between the first combustion electrode 18 and the second combustion electrode 20 (combustion ground) and passes through the combustion flame. The lines of electric field 54, are produced and controlled by a detector circuit 62, as shown in detail in FIG. 4 and discussed herein later, which is ultimately responsible for the control and supervision of the electrodes 18 and 20. A detector circuit 62 for each set of electrodes is connected between the electrode and ground by conductors 50 and 66 (For demonstration only one detector circuit is shown). The detector circuit includes a current sensing circuit couple to each of the first combustion electrode 18 and the second combustion electrode 20 (combustion ground). The detector circuit is also responsible for indicating a current that is proportional to the combustion product level within the combustion process (flame) 40.

Figure 4A:
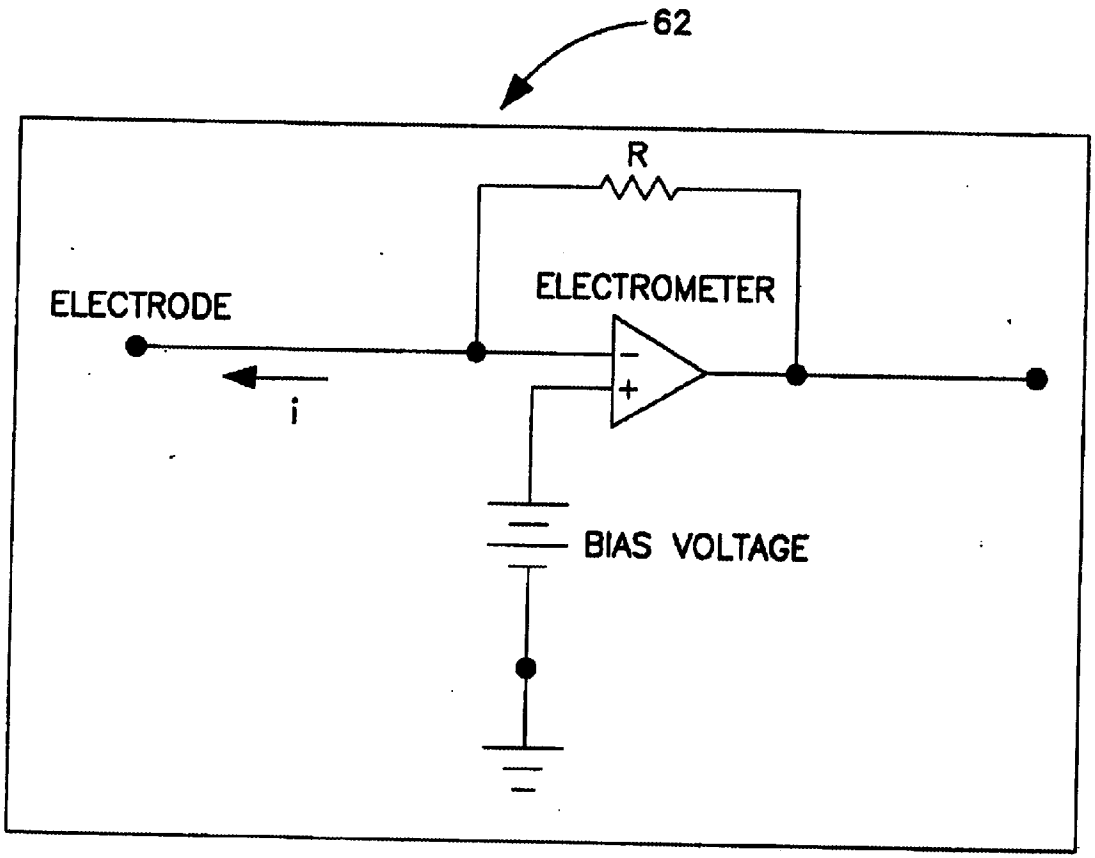
FIGS. 4*a* and 4*b* are typical control detection circuits.
Figure 4B:
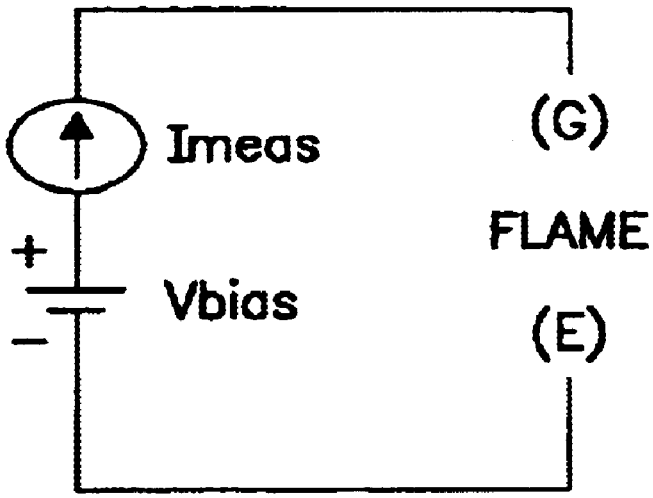

Each set of electrodes will have a separate detector circuit, with equal-potential bias voltage, so the current measured through each electrode is independent of the other. Examples of a typical control circuit for the monitoring of the combustion process are shown in FIGS. 4*a* and 4*b*. This circuit supplies a bias voltage to the electrode and measures the current conducted through the electrode. The remainder of the nozzle and combustion chamber are at reference ground potential in respect to the circuit shown in FIG. 4. The electrometer configuration shown in FIG. 4 provides a voltage output proportional to the amount of current conducted through the electrodes, which can be used to signal that a flashback condition has occurred. Other circuits may be used to interface to the flashback sensor electrodes, while maintaining the functionality of the flashback detection sensor.

In cooperation with the first combustion electrode 18 and the second combustion electrode 20 the detection circuit detects the level of combustion product within the combustion process (flame) 40, occurring within the electric current 54. Thereby, any change in the status of the electric fields 54, indicating that a change has occurred in the electric circuit is completed between the first combustion electrode 18, and the second electrode 20. The detector circuit may further comprise a current amplifying circuit and a processor. A microprocessor may be configured to indicate the level of hydrocarbon based on empirical data. The current generating subcircuit may provide either an alternating current (AC) or direct current (DC).

The location or anchoring of the combustion process (flame) can also be determined by the combustion sensor 16. When the flame is anchored or located near the first combustion electrode 18 a base current is established. As the flame 40 moves away from the first combustion electrode 18 the current is reduced by several orders of magnitude as the presence of conducting hydrocarbon ions is reduced. This reduction in current can indicated a movement of the flame front through the combustion zone 14. Typical the current flowing through a flame compared to current flow through gas/oxidant mixture changes from a ratio of 100 to 1.

Experimental Tests

The combustion sensor was installed in a low-pressure development combustion rig as shown in FIG. 1. The data discussed in the next section was collected using two combustion chamber configurations. The combustion configuration illustrated in FIG. 6 was constructed with two ¼ in (316 stainless steel tubes with ceramic inserts) electrodes installed 180E apart inside the cylindrical, quartz combustion tube. The two electrodes were electrically isolated from the remaining conductive combustor surfaces and were connected to the current measurement circuit by stainless steel wires. This configuration is referred to as the isolated electrode configuration. The second configuration as shown in FIG. 1 consists of a solid metal combustor tube, which was connected to the remaining conductive metal conductive metal surfaces (i.e., cumbustor ground, or earth). This configuration is referred to as the metal combustor configuration.

Figure 6A:
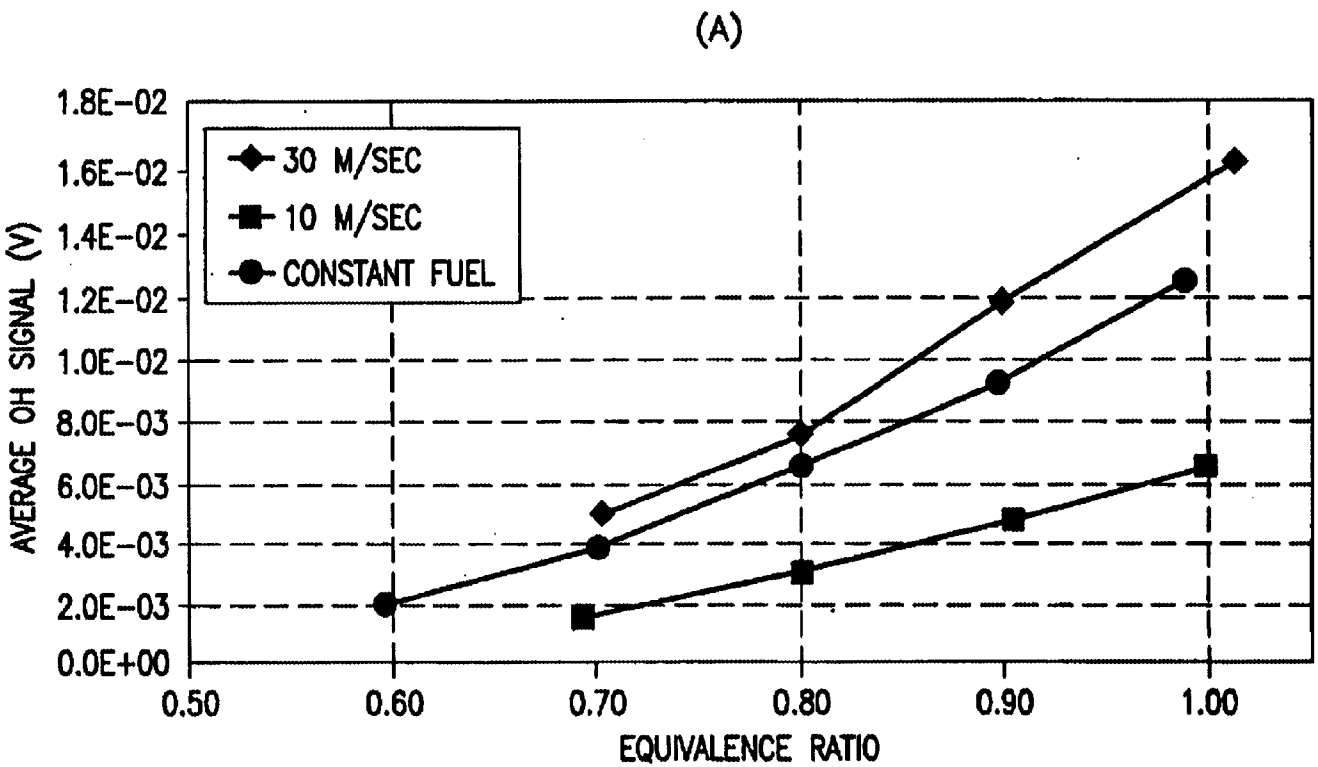
FIG. 6*a* is a graph of $OH^-$ measurement vs. equivalence ratios.

The current was measured using a variable DC power supply ammeter connected in series between the combustion first electrode and the two isolated combustion ground electrodes in the combustor, or to a combustor ground in the metal combustion (FIGS. 6 and 1). The DC ammeter was configured to average the current samples over 2 seconds to prevent dynamic oscillations (150 HZ or greater) from skewing the readings.

In addition, for comparison purposed, the chemiluminescence for the OH* radical is recorded using a high-speed data recorder. The chemiluminescence from the 210 nm OH* radical was recorded with a line filter and photomultiplier located on the downstream end of the combustor. The sensor is positioned to view the entire flame reaction zone. As explained elsewhere, the OH* chemiluminescence is believed to be approximately proportional to the instantaneous value of heat-release rate. Recent studies indicate that the proportionality may be non-linear and unable to account for all aspects of fuel conversion.

Results

Figure 8A:
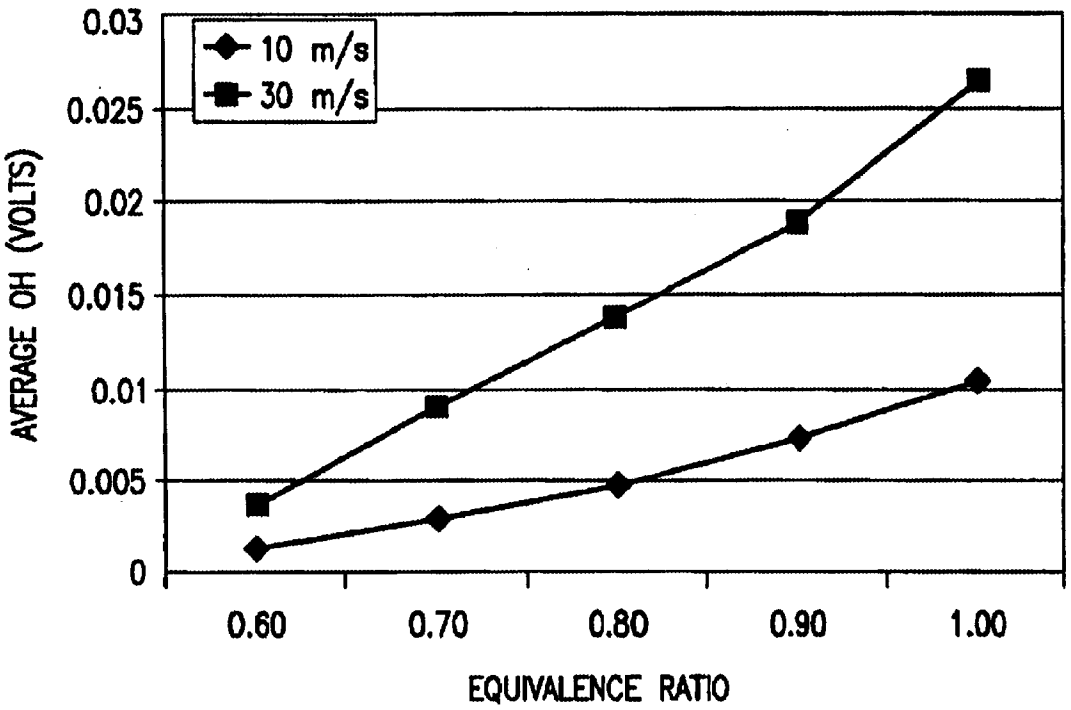
FIG. 8*a* is a graph of $OH^-$ measurement vs. equivalence ratios.

The test results discussed here include three flow conditions. For two conditions, the bulk flow velocity of the combined fuel and airflow to the combustor are maintained approximately constant at rates of 10 m/sec and 30 m/sec. For the third condition (FIGS. 8 and 9), the fuel flow was approximately constant at 136 $sft^3$/hr (Constant fuel), and the airflow changes to produce the equivalence ratios (This also changes bulk flow velocity).

Figure 5:
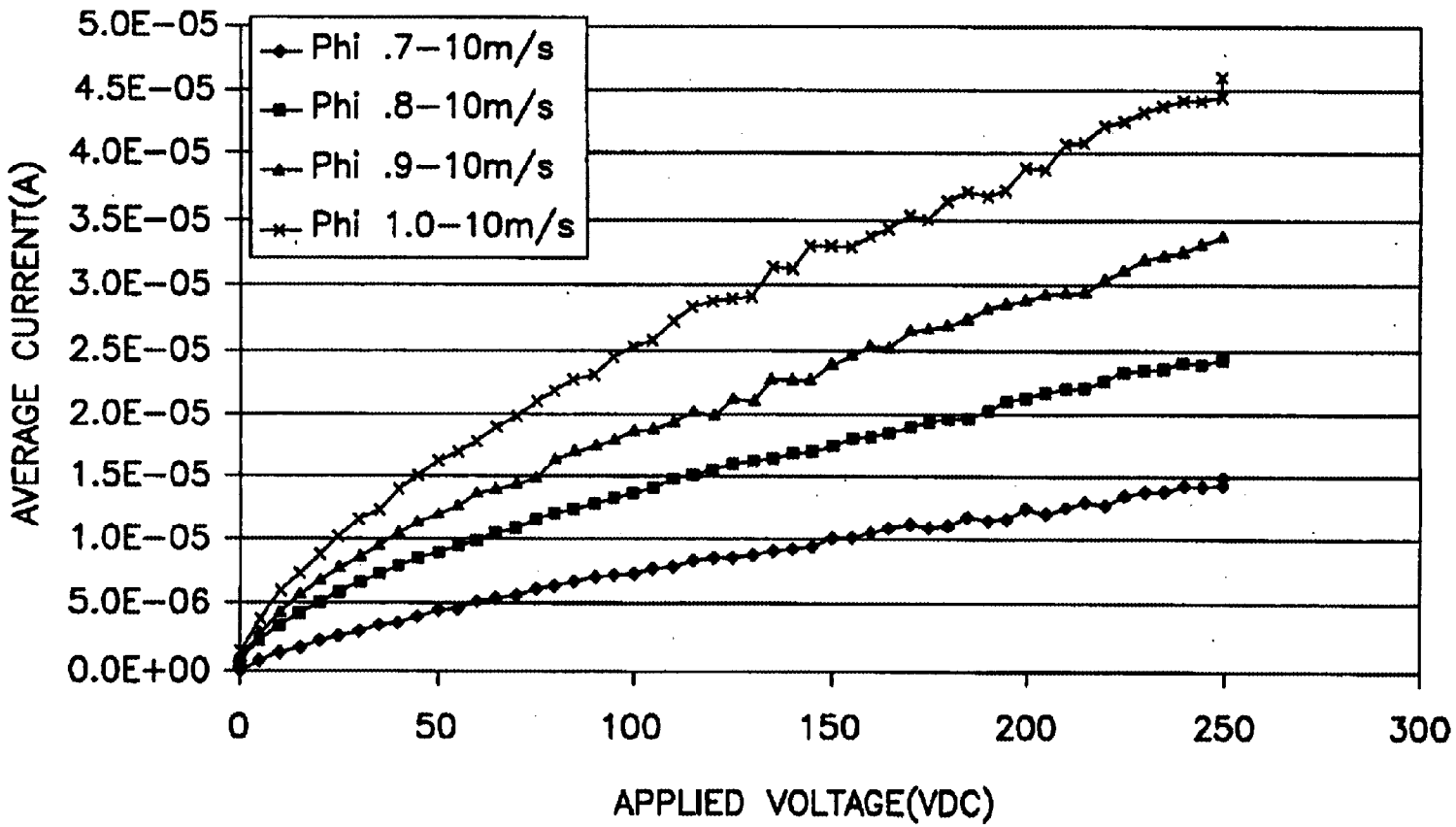
FIG. 5 is a graph of voltage vs. current for a constant bulk velocity.

In the isolated electrode combustor configuration (FIG. 1), the electric field is constrained between the first combustion electrode and the two isolated electrodes (E) inside the combustion chamber. The data in FIG. 5 shows the current (Imeas) versus the applied voltage (Vbias) for 10 m/sec. Bulk flow velocity, where the relationship is linear over a range of equivalence ratios. This was much like the response of the FID, where changes in hydrocarbon concentration at a constant bulk flow velocity, yield a change in current. The data in FIG. 5 shows that an increase in equivalence ratio (i.e., an increase in hydrocarbon concentration) produces more current through the flame.

Figure 6B:
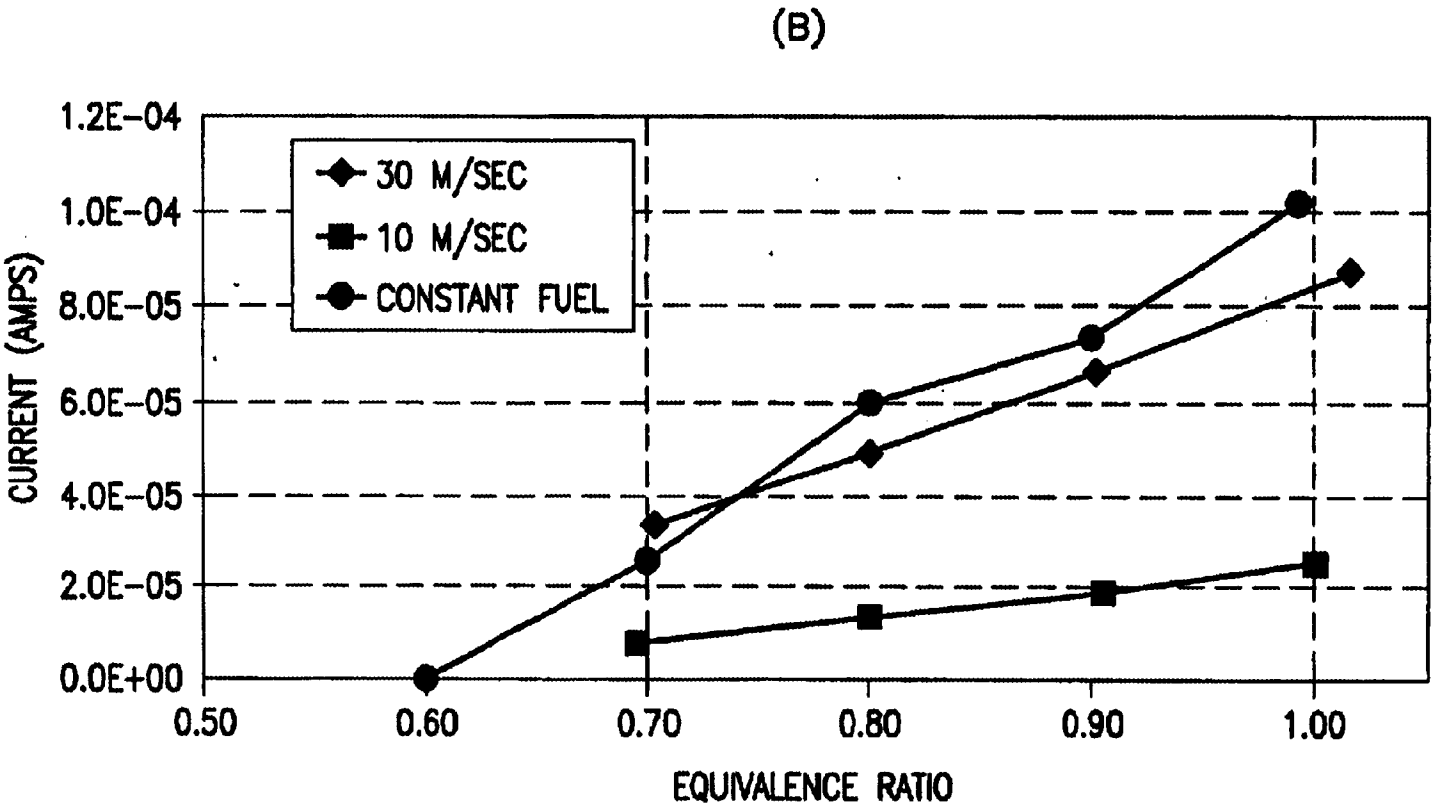
FIG. 6*b* is a graph of average current with Vbias of 100 VDC vs. equivalence ratios.
Figure 7A:
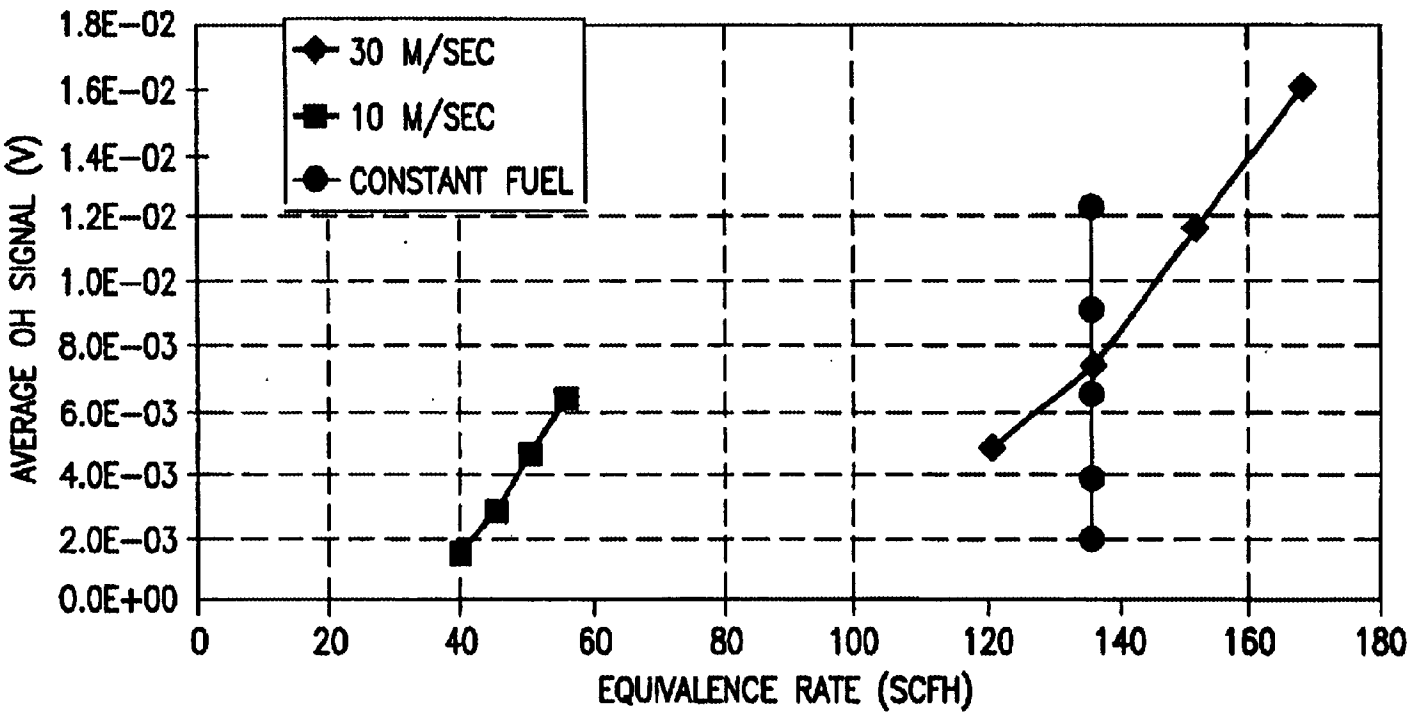
FIG. 7*a* is a graph of $OH^-$ measurement vs. fuel flow rates.
Figure 7B:
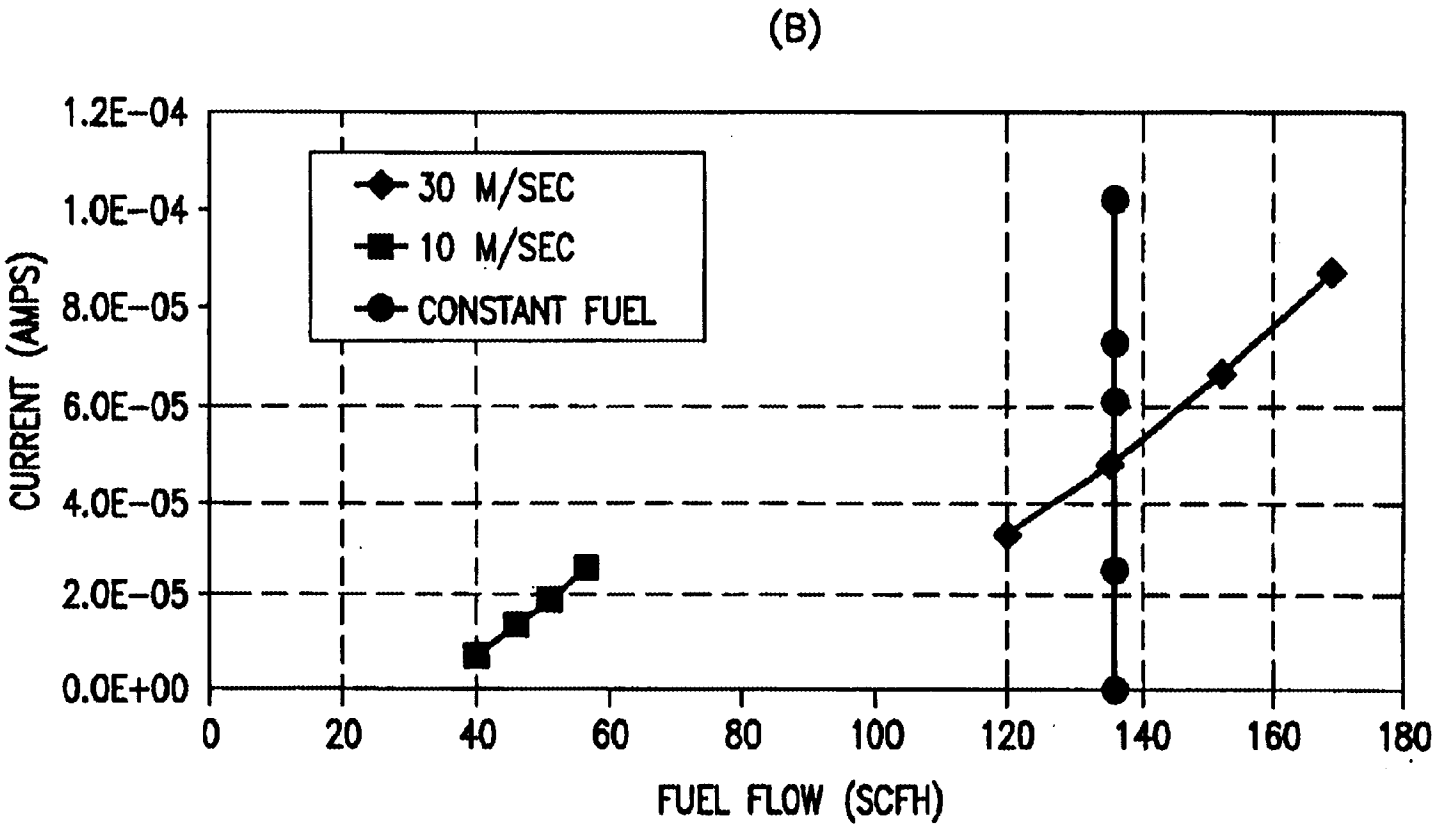
FIG. 7*b* is a graph of average current with Vbias of 100 VDC vs. equivalence ratios.

The data in FIG. 6*b* shows that the measure current through the flame is linearly proportional to the operating equivalence ratio of the combustor at nearly all conditions shown. FIG. 7*b* shows that a variation in equivalence ratio when the fuel flow is constant causes a change in the measure current. Additionally, the data in both FIGS. 6 and 7 show comparable trend of measured current versus the measured OH* radical at various equivalence ratios and fuel rates. It should be noted that the formyl radical, HCO*, is though to be a better indicator of fuel consumption rate and heat release rate the OH*.

Figure 8B:
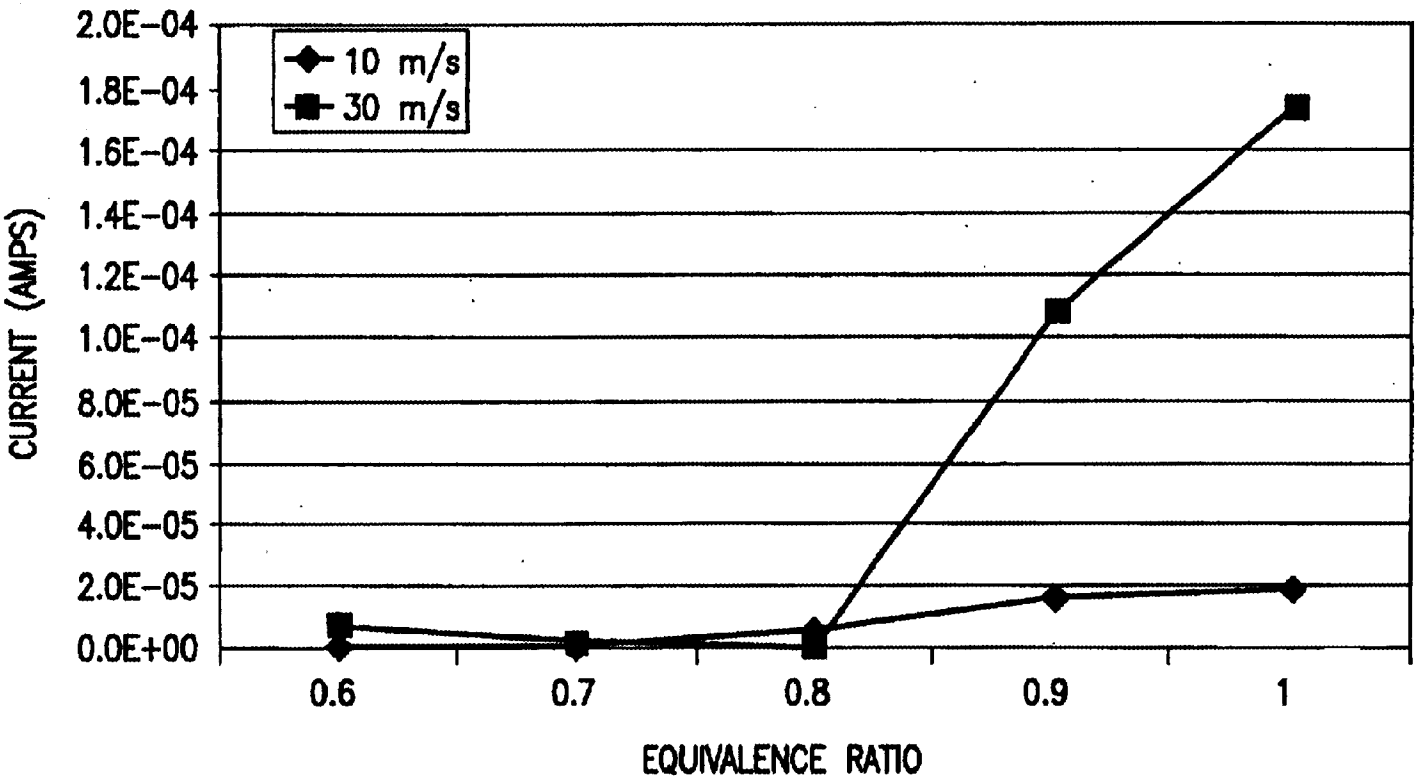
FIG. 8*b* is a graph of average current with Vbias of 100 VDC vs. equivalence ratios.

The data in FIG. 8*b* shows the measured current versus the operating equivalence ratio for bulk flow velocities of 10 m/sec. and 30 m/sec. The data shows a highly non-linear relationship between the current and the equivalence ratio. At lower equivalence ratios, the measured current is significantly lower than at an equivalence ratio of 1.0. This suggests that at higher firing rates, the combustion chamber temperature be significantly increased. As well, the flame front operates close to the step expansion where the electric field is the highest. Furthermore, the data in FIG. 10*a* shows that the average OH* measurement is linear with equivalence ratio, thus the heat release rate is consistent with the operation conditions.

While the invention has been particularly shown and described with reference to a preferred embodiment hereof, it will be understood by those skilled in the art that several changes in form and detail may be made without departing from the spirit and scope of the invention.

We claim:

1. An apparatus for the real-time monitoring and control of the combustion process in the combustion zone of a burner assembly of a combustion system, the apparatus comprising:

flow-through combustion means having upstream and downstream end portions in fluid communication;

said upstream end portion having at least one fuel mixing chamber including fuel supplying means for supplying a hydrocarbon fuel at a first rate and oxidizer supplying means for supplying an oxidizer at a second rate in flow-through communication with said downstream end portion;

combustion means disposed in said downstream end portions including an outer shell having a fuel nozzle, having upstream and downstream portions, disposed therein downstream from and in flow-through communication with said fuel mixing chamber;

a means for initiating the combustion process with the hydrocarbon fuel and oxidizer to maintain a combustion flame plume during operation of the combustion burner assembly, wherein the products of combustion include hydrocarbon ions;

a sensor positioned within the combustion means, said sensor including a first electrode and a second electrode in axially spaced-apart relation to provide for flame plume, wherein a portion of the flame plume is disposed between the first and second electrodes;

means for applying a predetermined voltage between the first and second electrodes; and means for determining the magnitude of the current between first and second electrodes to selectively measure the concentration of hydrocarbon ions in said flame plume.

2. The apparatus of claim 1 wherein said sensor first electrode is centered in the fuel nozzle adjacent to the second end.

3. The apparatus of claim 1, wherein the second electrode is radially outward of the first electrode.

4. The apparatus of claim 3, wherein the sensor second electrode is part of the outer shell and the outer shell is electrically insulated from the downstream portion of the nozzle.

5. The apparatus for the monitoring and control of the combustion process of claim 1, wherein the nozzle is a lean premix fuel combustion nozzle.

6. The apparatus of claim 1, wherein said first and second electrodes are spaced apart and insulated by a ceramic material.

7. The apparatus of claim 1, wherein said fuel supplying means means for supplying a hydrocarbon-based fuel to the fuel nozzle at a first rate that is electronically coupled to said means to determine the magnitude of the current between the first and second electrodes.

8. The apparatus of claim 1 wherein the first and second electrodes are located within the combustion chamber.

9. The apparatus of claim 1 wherein the rate of supply of the hydrocarbon-based fuel to the nozzle and the rate of supply of oxidizer to the nozzle is maintained at about a constant level, wherein a decrease in the magnitude of the current indicates the movement of the combustion process away from the first electrode.

10. The apparatus of claim 1, wherein the change in the magnitude of the current is proportional to the change in the amount of hydrocarbon ions in the combustion process.

11. A apparatus for the real-time monitoring and control of the combustion process in combustion zone of a lean premix burner of a combustion system, the system comprising:

flow-through combustion means having upstream and downstream end portions in fluid communication;

said upstream end portion having at least one fuel mixing chamber including fuel supplying means for supplying a hydrocarbon fuel at a first rate and oxidizer supplying means for supplying an oxidizer at a second rate in flow-through communication with said downstream end portion;

combustion means disposed in said downstream end portions including an outer shell having a lean premix fuel nozzle, having upstream and downstream portions, disposed therein downstream from and in flow-through communication with said fuel mixing chamber and a center body surrounded by the nozzle;

a means for initiating the combustion process of the hydrocarbon fuel and oxidizer to maintain a combustion flame plume during operation of the combustion burner assembly, wherein the products of combustion include hydrocarbon ions;

a sensor positioned within the combustion means, said sensor including a first electrode and a second electrode in axially spaced-apart relation to provide for flame plume, wherein a portion of the flame plume is disposed between the first and second electrodes, wherein said sensor first electrode is centered in the lean premix nozzle center body;

means for applying a voltage between the first and second electrodes; and means for determining the magnitude of the current between said first and second electrodes to selectively measure the concentration of hydrocarbon ions in said flame plume.

12. The apparatus of claim 11 wherein the change in magnitude of the current between the first and second electrode identifies the presence of a flame.

13. A process for monitoring and control of the combustion process in combustion zone of a lean premix burner of a combustion system, the process comprising:

providing a combustion system comprising a fuel nozzle having a fuel inlet, a gas inlet, and an outer shell, wherein at a portion of the outer shell defines a combustion zone and a sensor positioned within the combustion system, said sensor including a first electrode and a second electrode in spaced-apart relationship of the first electrode, supplying a hydrocarbon-based fuel to the fuel nozzle at a first rate;

supplying an oxidizer to the fuel nozzle at a second rate;

mixing the fuel and the oxidizer;

igniting the hydrocarbon-based fuel-oxidizer mixture such that the combustion process proceeds, wherein at least a portion of the combustion process takes place between the first and second electrodes;

applying a voltage between the first and second electrodes; and measuring the magnitude of a current between the first and second electrodes wherein the first rate at which the fuel is supplied is adjusted to maintain the magnitude of the current between the first and second electrode at about a constant level.

14. A process for monitoring and control of the combustion process in combustion zone of a lean premix burner of a combustion system, the process comprising:

providing a combustion system comprising a fuel nozzle having a fuel inlet, a gas inlet, and an outer shell, wherein at a portion of the outer shell defines a combustion zone and a sensor positioned within the combustion system, said sensor including a first electrode and a second electrode in spaced-apart relationship of the first electrode, supplying a hydrocarbon-based fuel to the fuel nozzle at a first rate;

supplying an oxidizer to the fuel nozzle at a second rate;

mixing the fuel and the oxidizer;

igniting the hydrocarbon-based fuel-oxidizer mixture such that the combustion process proceeds, wherein at least a portion of the combustion process takes place between the first and second electrodes; applying a voltage between the first and second electrodes; and measuring the magnitude of a current between the first and second electrodes wherein the second rate at which the oxidizer supplied is adjusted to maintain the current between the first and second electrode at about a constant level.

* * * * *